US005890540A

United States Patent [19]

Pia et al.

[11] Patent Number: 5,890,540

[45] Date of Patent: Apr. 6, 1999

[54] DOWNHOLE TOOL

[75] Inventors: Giancarlo Tomasso Pietro Pia, Aberdeen; Richard Alvin Armell, Montrose, both of Scotland

[73] Assignee: Renovus Limited, Aberdeen, Scotland

[21] Appl. No.: 675,922

[22] Filed: Jul. 5, 1996

[30] Foreign Application Priority Data

Jul. 5, 1995 [GB] United Kingdom ..... 9513657.8

[51] Int. Cl.[6] ..... E21B 34/10

[52] U.S. Cl. ..... 166/321; 166/332.2

[58] Field of Search ..... 166/319, 321, 166/331, 332.2, 240

[56] References Cited

U.S. PATENT DOCUMENTS

| | | | |
|---|---|---|---|
| 4,298,077 | 11/1981 | Emery | 175/65 |
| 4,403,659 | 9/1983 | Upchurch | 166/331 X |
| 4,657,082 | 4/1987 | Ringgenberg | 166/331 X |
| 4,669,541 | 6/1987 | Bissonnette | 166/332.2 X |

FOREIGN PATENT DOCUMENTS

| | | |
|---|---|---|
| 0 063 519 | 10/1982 | European Pat. Off. . |
| 0 158 465 | 10/1985 | European Pat. Off. . |
| 0 223 552 | 5/1987 | European Pat. Off. . |
| 2 006 853 | 5/1979 | United Kingdom . |
| 1 547 816 | 6/1979 | United Kingdom . |

*Primary Examiner*—William Neuder
*Attorney, Agent, or Firm*—Alston & Bird

[57] ABSTRACT

A downhole tool comprises a tubular body (12) for location in a tubular member, such as a drill string, and defines a through bore (20) and a number of circumferentially spaced ports (26). A valve member which may be in the form of a piston sleeve (24) is mounted in the bore (20) and is movable relative to the body (12) between a first position in which fluid may flow through the port (26) and a second position in which the valve member (24) closes the port (26), the valve member being movable between the first and second positions by application of differential fluid pressure. Movement of the valve member (24) is provided by a cam arrangement including a circumferentially extending cam groove (56) and a cam follower (57).

18 Claims, 4 Drawing Sheets

DOWNHOLE TOOL

This invention relates to a downhole tool, and in particular to a pressure actuated flow control tool or tool actuator for use in downhole applications.

In downhole operations in, for example, the oil and gas exploration and extraction industries, long tubular members or strings are used to locate drill bits, drill motors and a wide variety of other tools and apparatus in well bores. The internal bore of larger diameter tubular members may provide a conduit down which other tools and apparatus may be lowered on, for example, wireline or coil tubing. The tubular members may also provide a conduit to carry fluid from the surface to a desired location in the well.

In drilling operations, a drill bit is mounted on the end of a tubular string. The string may be used to transfer rotation from the surface to the bit and will also carry drilling fluid or "mud" from the surface to the bit. The mud exits through flow jets in the bit to act as a lubricant for the drilling operation and then carries drill cuttings up the annulus between the string and the bore wall. The mud is collected on the surface and is treated to remove the cuttings and any other contaminants before being reused. The properties of the drilling mud are important to a successful drilling operation and the mud will contain a variety of constituents in carefully controlled proportions. The mud is thus relatively expensive.

Under certain conditions, a drilled bore may intersect a porous rock formation, and the drilling mud passing upwardly through the annulus from the bit may pass into the porous rock rather than continuing up the annulus to the surface. An enormous volume of mud may be lost in such circumstances, at great expense to the drilling operator. This situation is generally referred to as lost circulation, and is treated by attempting to seal the porous formation. This may require the removal of the drill string to allow an open ended string to be run in to allow sealing materials to be applied directly to the formation.

Removal of the drill string is not required if it possible to pass the sealing materials through the wall of the drill string at the appropriate location in the bore. One system which is intended to allow this procedure is the Multiple Activation Bypass System by PBL Drilling Tools Ltd of Calgary, Alberta. The system provides a tool with a tubular body for location in a drill string. The body accommodates a sleeve which is spring biassed upwards to close a circulating port in the body wall. When it is desired to direct fluid from the string bore to the annulus the string is broken at the surface and a vinyl ball is dropped down the bore. On reaching the tool the ball engages a suitable profile in the sleeve to block flow through the tool. On commencing normal pumping the resulting build-up of pressure above the ball pushes the sleeve downwardly to open the circulating port. Sealing material may then be pumped through the port. To close the port, the string is again broken at the surface and a smaller diameter steel ball dropped down the bore on top of the vinyl ball. On pressuring up, the steel ball forces the vinyl ball past the profile and both balls drop into a ball catcher which defines bypass passages around the balls. The procedure may be repeated up to six times, until the ball catcher is full.

The PBL tool clearly offers significant advantages over the previous procedure, but does suffer from a number of disadvantages: many operators are reluctant to use a tool which will create an obstruction and flow restriction in the bore, as created by the ball retaining profile, the ball catcher and, in particular, the balls located in the catcher; it is necessary to break the string twice for each use of the tool and then wait until the balls are positioned in the tools before pumps may be returned to normal flow rates, resulting in considerable lost rig time; and the tool may only be used a limited number of times before it must be retrieved for unloading and resetting. The PBL tool may be used in a number of other applications, but in all cases these disadvantages will be apparent.

It is among the objects of the embodiments of the present invention to obviate or mitigate these disadvantages.

According to one aspect of the present invention there is provided a downhole tool comprising:

a tubular body for location in a tubular member and defining a body wall, a longitudinal through bore and a flow porz through the body wall;

a valve member mounted in the bore and being moveable relative to the body between a first position in which fluid may flow through the port and a second position in which the valve member closes the port, the valve member being moveable between the first and second positions by application of differential fluid pressure; and control means for controlling movement of the valve member between the first and second positions in the form of a connection between the body and the valve member including a cam arrangement having a circumferentially extending cam groove and a cam follower, the arrangement being such that the cam follower will only move in one direction along the groove and the position of the valve member will change in a predetermined sequence.

The tool is particularly suited for use in the oil and gas exploration and production industries and will be described, for illustrative purposes only, with reference to applications in these industries. Thus, the tool may be located in a rotational drill string, coiled tubing or other tubular members and used to direct the flow of fluid from the tubular member into the annulus between the member and the wall of the drilled bore. The apparatus will be described in a particular orientation and as having "upper" and "lower" parts. However, those of skill in the art will realise that the apparatus may be used when inclined, horizontal or inverted and that use of these terms is only for ease of explanation and is not intended to be limiting.

In use, the configuration of the valve member, allowing movement in response to differential pressure across the member, permits the member to be moved merely by varying the rate at which fluid is pumped down the tubular member. This obviates the requirement to provide balls or other tools which must be dropped into the apparatus to create a pressure or flow responsive restriction. Accordingly, the cycle time of the apparatus may be very short and the apparatus may be used many times without having to be brought to the surface for unloading or resetting. Further, the provision of the control means allows an operator to control the valve member position with certainty and accuracy simply by varying the pumping rate at the surface.

Preferably, the valve member also defines a flow port and at least one of the valve member and the body define a plurality of flow ports of different flow areas such that, with the valve member in different positions, the flow ports of the valve member and the body are aligned to provide different flow areas therethrough. This permits the position of the valve member relative to the body to be determined at the surface by measurement of the back pressure created by the tool.

Preferably also, the cam groove extends completely around the circumference of the body or valve member to allow the apparatus to be cycled indefinitely. Alternatively, the cam groove includes a stop to prevent further movement of the valve member relative to the body beyond a predetermined point.

Preferably also, the valve member is moveable between three or more circumferentially spaced positions. Further, the valve member is preferably moveable between three or more axially spaced positions. These positions are made available by provision of an appropriate cam profile. These features allow the tools in accordance with the invention to be utilised in a large number of downhole applications and perform a variety of functions.

Preferably also, the valve member is in the form of a sleeve. Most preferably, the sleeve is located in a portion of the body defining an enlarged cross-section bore, such that the sleeve may define a through bore which does not create a restriction in the bore of the tubular member. Preferably also, the sleeve defines a tubular piston, with a relatively large area upper end surface, such that flow of fluid through the sleeve creates a differential pressure across the sleeve and produces a downward force on the sleeve.

The body may also accommodate a restriction member in the form of a valve seat for cooperation with the valve member to restrict flow through the bore when the valve member is in the first position, and to permit flow through the bore when the valve member is in the second position. Thus, the provision of the valve seat allows the apparatus to redirect fluid flow from the tubular member into the annulus. Most preferably, the valve member is retrievable from the body, such that the restriction in the bore created by the valve seat may be removed from the body, and the tubular member, without having to retrieve and dismantle the tool, with subsequent loss of rig time.

In the absence of the valve seat, fluid may flow through both the flow port and the body bore when the valve member is in the first position. The relative proportions of flow may be controlled or varied by a number of factors, including the configuration of the flow port, which may be provided with a flow jet nozzle, the number of flow ports provided, the length of tubular member below the apparatus, and the back pressure created by the bottom hole assembly (BHA) mounted to the lower end of the tubular member.

Preferably also, spring means is provided for biassing the valve member in one direction relative to the body and a bearing is provided between the spring means and one of the body or valve member for reducing the rotational friction therebetween.

According to another aspect of the present invention there is provided a downhole tool comprising:

- a tubular body for location in a tubular member and defining a body wall and a longitudinal through bore;
- a tubular valve member mounted in the bore and being axially and rotatably moveable relative to the body between a first position and a second position, the valve member being moveable between the first and second positions by application of differential fluid pressure across the valve member;
- a restriction member mounted on the body for cooperation with the valve member to provide a first flow through the bore when the valve member is in the first position, and to permit a second flow through the bore when the body is in the second position; and
- control means for controlling movement of the valve member between the first and second positions.

This aspect of the invention may be combined with the first aspect of the present invention.

Preferably, the body defines a flow port through the body wall and in the first position the valve member permits fluid flow through the port and in the second position the valve member closes the port.

The restriction member may be in the form of a choke plug or valve seat. Depending on the axial or rotational position of the valve member relative to the body and thus relative to the restriction member the flow through the bore may be varied from zero to a maximum.

According to a further aspect of the present invention there is provided a downhole tool comprising:

- a tubular body for location in a tubular member and defining a body wall and a longitudinal through bore;
- a tubular member mounted in the bore and being axially and rotatably moveable relative to the body from a first position to a second position, the tubular member being moveable from the first position to the second position by application of differential fluid pressure across the member; and
- a connection for linking the tubular member to a further downhole tool to permit the movement of the tubular member to be utilized to actuate said further tool.

The tool may be utilised to operate a range of tools and valves positioned above, below or on the actuating tool.

This aspect of the invention is preferably provided in combination with the one or both of the other aspects of the invention described above. In particular, the body and tubular member may be provided with flow ports that cooperate when the tubular member is in different positions to provide different flow areas, thereby permitting the position of the tubular member to be determined at the surface by monitoring back pressure.

These and other aspects of the present invention will now be described, by way of example, with reference to the accompanying drawings, in which.

Figures 1, 2, 3, 4:
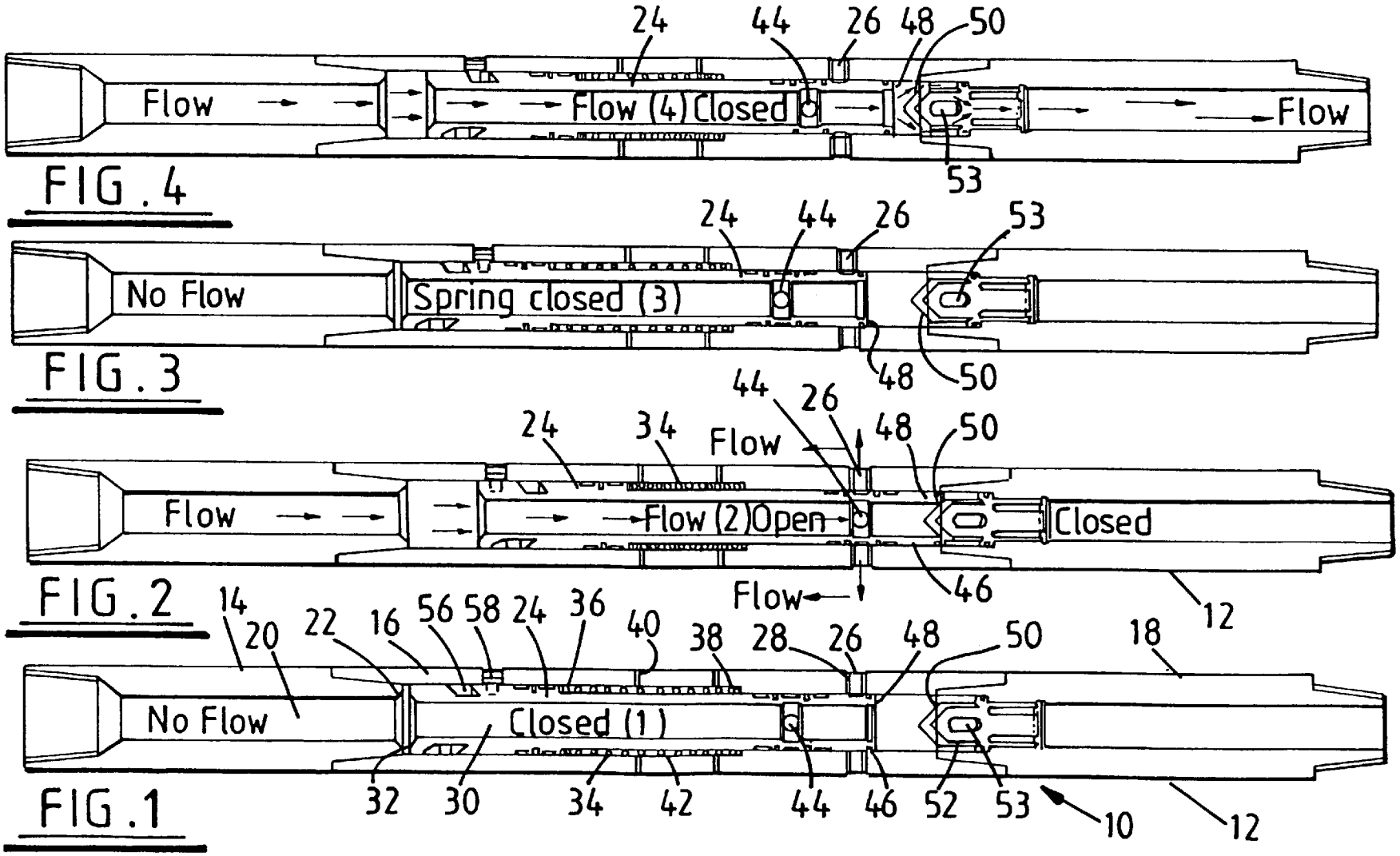
FIGS. 1, 2, 3 and 4 are sectional views of a flow control tool in accordance with a first embodiment of the present invention, including a valve seat, and illustrate the operating cycle of the apparatus.

Reference is first made to FIG. 1 of the drawings, which illustrates a flow control tool 10 in accordance with a first embodiment of the present invention. The tool 10 as illustrated is suitable for location in a rotational drill string. The tool 10 includes an elongate tubular body 12 comprising a top sub 14, a central body 16, and a bottom sub 18, in this particular example the parts of the body being connected by standard API connections. The top sub 14 is a box-to-pin sub with API connections and defines a through bore 20 and is primarily used as a saver sub with fishing neck. The only non-standard API aspect is a modified chamfer 22 on the lower end. The bottom sub 18 is a pin-to-pin sub with API connections and also defines a through bore. The centre body 16 comprises a heavy box-to-box connection body with an enlarged bore accommodating a valve member in the form of a sleeve 24. The lower end of the body 16 defines four circumferentially spaced ports 26 accommodating flow jets 28. The ports 26 are selectively sealed by the lower end of the sleeve 24, as will be described.

The sleeve 24 effectively defines a hollow piston with an internal bore 30 of similar diameter to the top and bottom sub bores, and the bore of the string in which the tool 10 is located. The sleeve upper end surface 32 is relatively large such that flow of fluid through the bore 30 creates a downward differential pressure force on the sleeve 24. This force is resisted by a coil spring 34 mounted between the sleeve 24 and the body 16, the spring 34 being restrained between a downwardly directed sleeve face 36 and an upwardly directed body face 38. Holes 40 in the body 16 allow fluid communication between the spring-containing chamber 42 and the annulus between the body 12 and the external bore, to prevent differential pressure locking.

Towards the lower end of the sleeve 24 are four flow ports 44 which may be aligned with the body ports 26 to allow fluid communication between the body bore and the annulus. The lower end of the sleeve 46 defines a valve seat 48 which, with the sleeve 24 in its lower position, engages with a restriction member in the form of a valve seat 50 in the upper end of the bottom sub 18. The valve seat 50 is defined by the base of a tapered cone formed on the upper end of a body 52 defining four elongate slots 53 of equal area to the ports 26, 44. The body 52 is secured in the bottom sub 18 by an appropriate anchoring collet.

Figure 5:
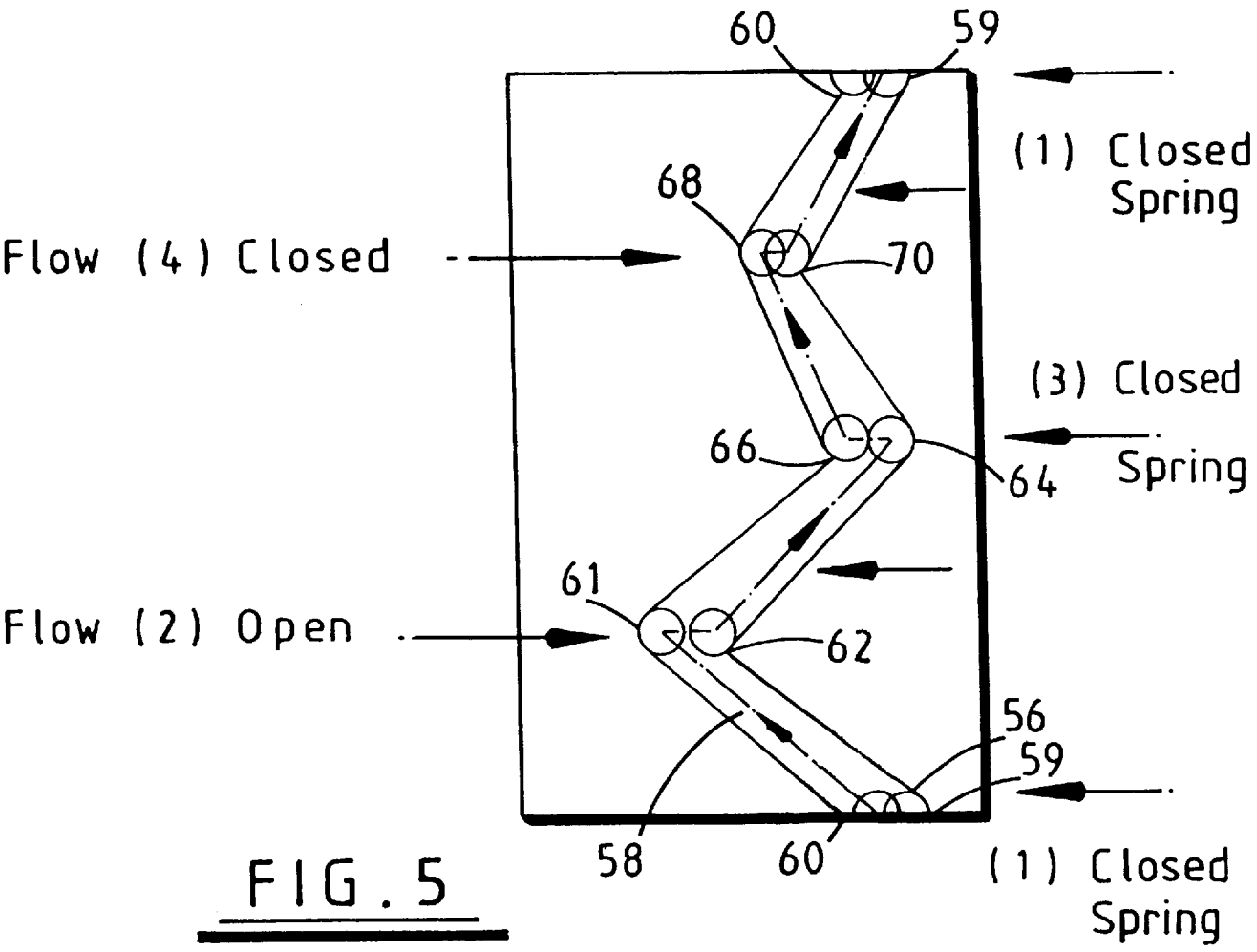
FIG. 5 is an illustrative of the movement of a cam groove on a piston sleeve of the tool of FIGS. 1 to 4 relative to a cam pin on the body of the tool when following the operating sequence illustrated in FIGS. 1 to 4.
Figure 9:
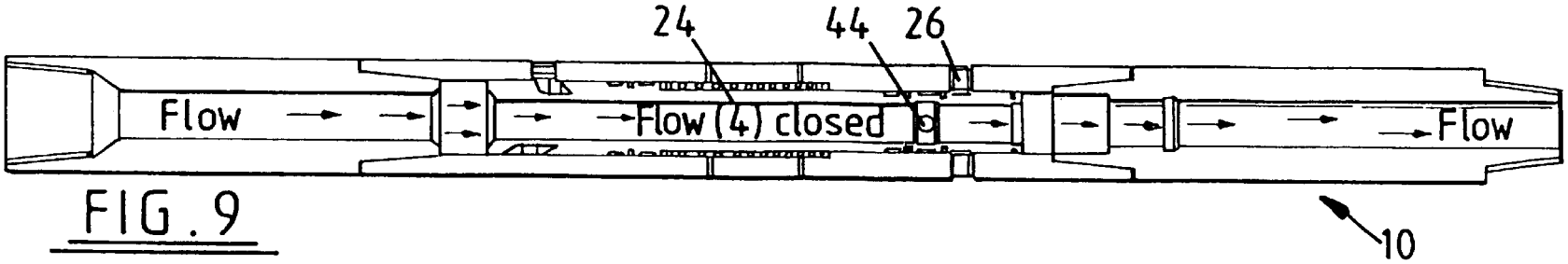
FIGS. 6, 7, 8 and 9 are sectional views of the flow control tool corresponding to FIGS. 1 to 4, but without the valve seat.
Figure 8:
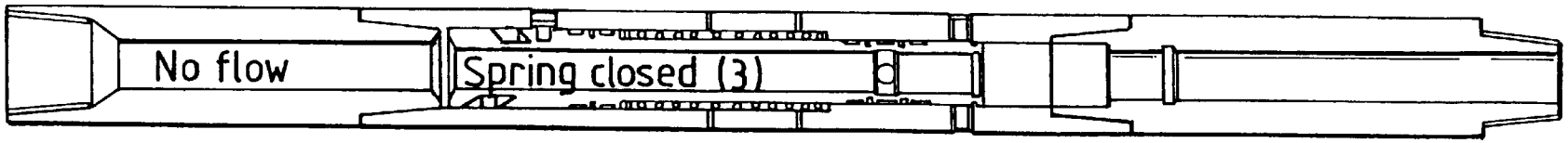

The upper end of the sleeve 24 defines a cam guide or groove 56 on its outer surface which co-operates with a cam pin 58 mounted on the body 16. FIGS. 1, 2, 3 and 4 of the drawings illustrate the movement of the sleeve 24 relative to the body 16, which is controlled by the interaction of the cam groove 56 and cam pin 58, the movement of the cam pin 58 relative to the groove 56 being illustrated to FIG. 5 of the drawings.

An initial sleeve position is illustrated in FIG. 1; there is little or no fluid flow through the body 12 such that the spring 34 pushes the sleeve 24 to the top of its travel. The position of the cam pin 58 in the cam groove 56, that is abutting cam stop 59, is illustrated as position 1 in FIG. 5. In this position the body ports 26 and the sleeve ports 44 do not align such that the body ports 26 are blanked off by the lower end of the sleeve 24.

On pumping fluid down through the body 12, the differential pressure force acting on the sleeve 24 overcomes the spring force and allows the sleeve 24 to travel downwardly. The offset location of cam peak 60, opposite the stop 59, ensures that the pin travels in a predetermined direction to a first flow position as illustrated in FIG. 2 (position 2 in FIG. 5) in which the cam pin 58 engages a further cam stop 61. In this position the valve seat 48 on the sleeve lower end 46 engages the valve seat 50 and the sleeve ports 44 are aligned with the body ports 26, such that all of the fluid flow is diverted through the body ports 26 into the annulus.

On stopping or substantially reducing fluid flow through the body 12, the pressure force on the sleeve decreases and the spring 34 lifts the sleeve 24. Again, due to the location of the opposing cam groove peak 62 relative to the trough of stop 61, the sleeve 24 will rotate in the desired direction as it moves upwardly, until the pin 58 engages the stop 64. On reaching this position the lower end of the sleeve 24 again seals off the body ports 26, as illustrated in FIG. 3.

When flow starts again, the offset of the cam peak 66 opposite the stop 64 causes the sleeve 24 to rotate in this same direction as it moves downwardly under the influence of the differential pressure force, until encountering a cam stop 68. The stop 68 is located so that the sleeve 24 may only travel partially down the body 16, such that the sleeve ports 44 and the body ports 26 do not come into alignment, as illustrated in FIG. 4. Also, the valve seats 48, 50 are spaced apart, such that fluid may still flow over the valve seat 50 and through the slots 53, and down through the drill string below. This sleeve position may be identified a the surface by a different back pressure when compared to position 2 described above.

When flow is stopped or substantially reduced, the spring 34 pushes the sleeve 24 upwardly, and the offset cam peak 70 opposite the stop 68 again ensures that the sleeve rotates in the desired direction as it moves upwardly until engaging the cam stop 59.

The valve seat 50 may be removed from the tool body 12 using a suitable fishing tool, to provide an unobstructed bore through the tool. The tool 10 may also be provided in a string without the valve seat 50 to provide a somewhat different mode of operation, as will now be described with reference to FIGS. 6, 7, 8 and 9 of the drawings.

Figure 7:
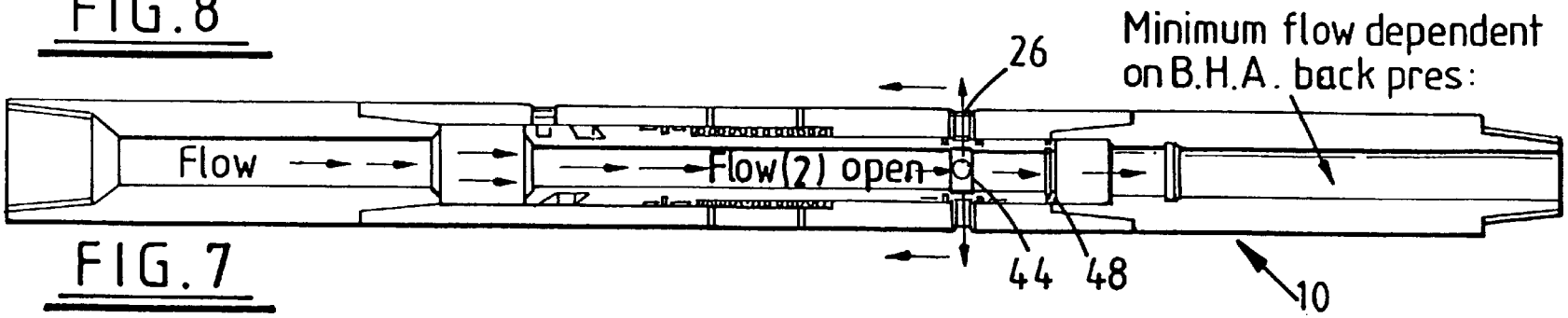
Figure 6:
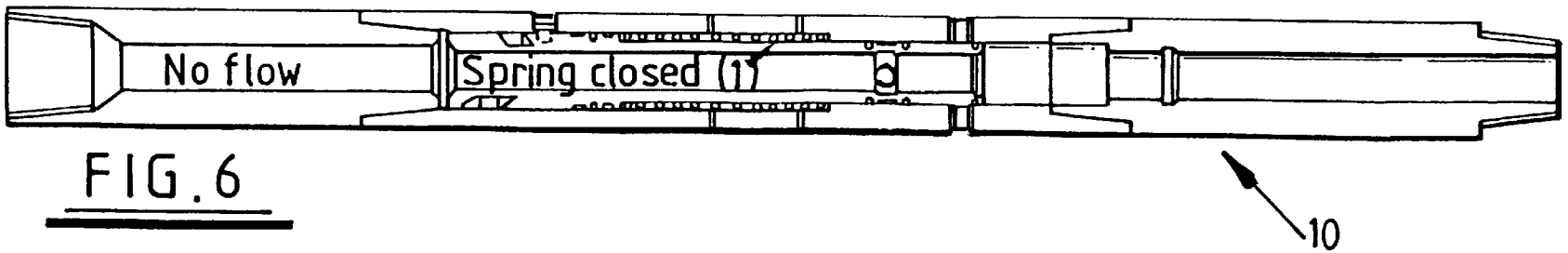

The tool 10 as illustrated in FIGS. 6, 7, 8 and 9 is identical to the tool shown in FIGS. 1, 2, 3 and 4, apart from the absence of the valve seat 50. This has no effect on the cycling of the tool, however at no point in the operating cycle is flow through the tool completely stopped. In position 2, as illustrated in FIG. 7, the sleeve ports 44 are aligned with the body ports 26, however there is no valve seat 50 to seal the lower end of the sleeve 24 such that a proportion of fluid continues to flow from the lower end of the sleeve. The relative proportions of flow directed through the sleeve ports 44 and passing downwardly from the tool 10 will depend upon a number of factors, including the back pressure created by restrictions in the bottom hole assembly. Typically, the majority of the flow ill pass through the sleeve ports 44.

Figure 10:
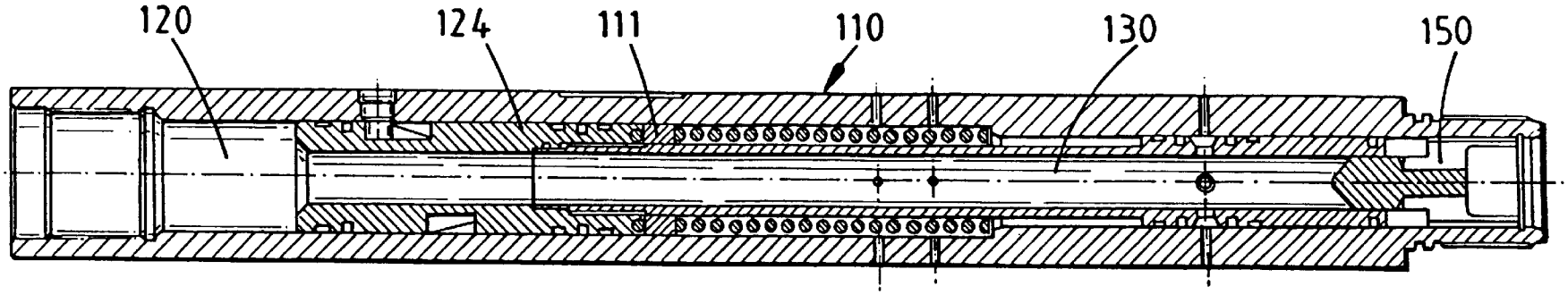
FIG. 10 is a sectional view of a flow control tool in accordance with a second embodiment of the present invention.

Reference is now made to FIG. 10 of the drawings, which illustrates a flow control tool 110 in accordance with a second embodiment of the present invention. The tool 110 operates in a substantially similar manner to the tool described above, and therefore only the differences between this and the first described embodiment will be described in any detail.

In this embodiment the restriction member is in the form of a fixed choke plug 150 which co-operates with the lower end of the sleeve 124. As with the first described embodiment, with the sleeve 124 in the first position (as illustrated), the sleeve 124 and the choke plug 150 co-operate to close the bore 120. The upper end of the choke plug 150 is of an external diameter which corresponds to the internal diameter of the sleeve bore 130 such that, with the sleeve 124 in the first position, the upper end of the choke plug 150 extends into and closes the bore through the sleeve 124.

A further difference between this apparatus 110 and the apparatus 10 described above is that a bearing 111 is provided between the spring 134 and the sleeve 124, to facilitate rotation of the sleeve 124 in the body 112.

Figure 11:
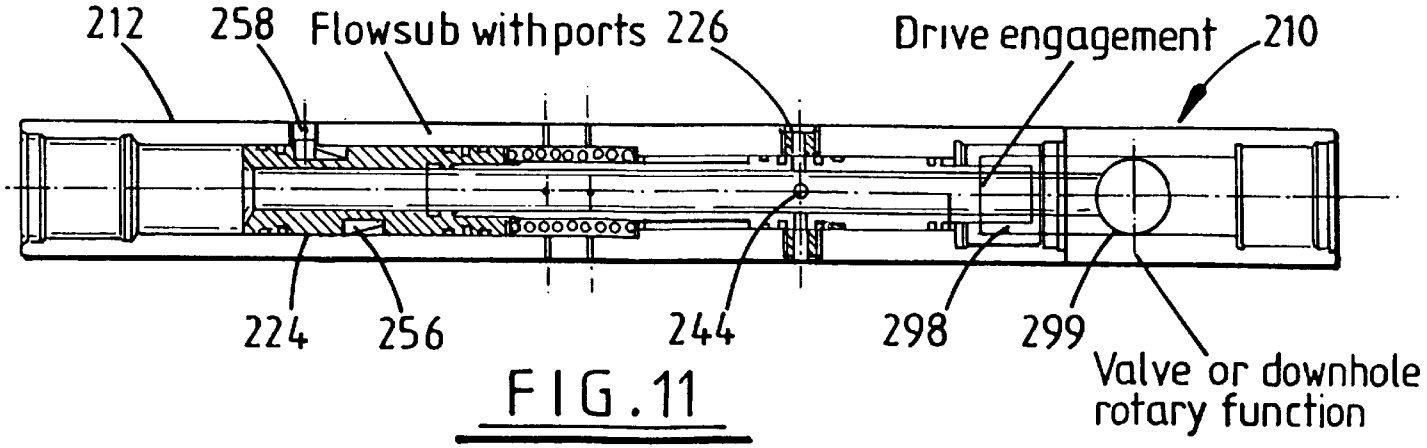
FIG. 11 is an actuating tool in accordance with another aspect of the present invention.

Reference is now made to FIG. 11 of the drawings, which illustrates an actuating tool 210 in accordance with a third embodiment of the present invention. The operates in a similar manner to the tools described above, in that the sleeve 224 is axially moveable in the body 212 in response to a fluid pressure differential created by pressurised fluid flowing through the sleeve, and that the cooperation of the cam groove 256 and cam pin 258 controls this movement and also provides for rotational movement of the sleeve 224 in the body 212. In this embodiment the movement of the sleeve 224 is utilised to actuate, that is rotate, a ball valve illustrated schematically at 299. The lower end of the sleeve is linked to the ball 299 by a drive member 298, the lower end of which engages the ball 299. Thus, by varying the bore pressure it is possible to cycle the sleeve 224, under the control of the cam arrangement, and close or open the valve as desired.

In other embodiments the sleeve 224 may be utilised to actuate tools or valves located in or on the body 212 or tools or located above or below the tool 210. The provision of flow ports 226, 244 in the body and sleeve allow the position of the sleeve 224 and thus the position or setting of the tool being actuated to be determined from the surface by monitoring the back pressure created by the tool 210; depending on the axial and rotational positioning of the sleeve 224 in the body 212 the ports 226, 244 will be aligned to provide a particular flow area unique to that positioning.

From the above-described embodiments it will be clear to those skilled in the art that embodiments of the present invention offer many advantages over existing bypass systems. The tools 10, 110 may be subject to an unlimited number of cycles or operations downhole without requiring retrieval for unloading or resetting. The use of flow and pressure differentials to operate the tools, typically by cycling rig pumps, simplifies operation and saves rig time, as there is no need to break the string or locate other tools or apparatus within the tool to cycle the tool. With the first embodiment, the absence of any permanent restrictions in the tool bore places no restriction on the drill string internal bore diameter, such that fluid flowrates may be maintained. Further, the maintenance of the full drill string internal bore without constriction allows free passage of darts, balls, wireline, coil tubing, survey tools and the like through the tool.

Although the embodiments described above are intended for use in a rotary drill string, it will be clear to those skilled in the art that embodiments of the invention may be used in other tubular members, such as coil tubing. Tools in accordance with embodiments of the invention may thus be used in a wide variety of applications including: rotary drill string or coil tubing drilling applications for flow diversion; as a diverter sub above bottom hole assemblies, especially motors; cuttings agitation to prevent lost circulation, key seating and cuttings build-up in high inclination and horizontal wells; use in long reach wells or long hole sections to increase low annulus drilling mud flow velocity and prevent cutting settling and to improve mud circulation; reduce lost circulation by reducing formation annular pressure; pressurise specific isolated zones in straddle packer operations; circulation of lost circulation material, dedicated well fluids, treatment fluids, slurry, cement, chemicals or gases to specific depths, zones or lithologies in open and cased holes without the requirement pass through the bottom hole assemblies; establish circulation in lost circulation zones and above or below struck pipe zones; isolate bottom hole assemblies form specific materials circulated through a string; use in conjunction with packers, tools and chemicals and completion operations; specific well work-over operations and coiled tubing operations; and inflating packers.

In view of the wide range of applications which are available for tools in accordance with embodiments of the present invention, it will be clear to those of skill in the art that the above-described embodiments are merely exemplary of the invention, and that various modifications and improvements may be made thereto without departing from the scope of the invention, some of which are described below.

If desired, the cam profile may be modified to provide for as many as six different axial sleeve positions, and a corresponding number of rotational positions. Further, in certain applications it may be desirable to provide a tool that will not cycle indefinitely, and this may be achieved by providing a stop on the cam profile.

The ports in the sleeve and body may be of various different configurations and diameters, such that different positions of the sleeve in the body provide for a different rate of flow into the annulus. This may be useful in certain operations, and also allows the position of the sleeve to be monitored at the surface, via back pressure measurements. Further, rather than simply providing "flow" and "no flow", the valve seat or choke plug may be arranged to co-operate with the lower end of the sleeve such that various intermediate flows are available. This may be achieved by providing a choke plug with a tapered profile or providing different sizes of ports or paths through the choke plug, such that the axial or rotational position of the sleeve relative to the choke plug permits a predetermined flow around or through the choke plug.

In other embodiments of the invention the flow ports in the body and sleeve may be omitted, such that the tool is utilised solely to control flow through the tool bore.

We claim:

1. A downhole tool comprising:

a tubular body for location in a tubular member and defining a body wall, a longitudinal through bore and a flow port through the body wall;

a tubular valve member mounted in the bore and being axially and rotatably moveable relative to the body between a first position in which fluid may flow through the port at a first flowrate and a second position in which the valve member closes the port, the valve member being moveable between the first and second positions by application of differential fluid pressure; and control means for controlling axial and rotational movement of the valve member between the first and second positions in the form of a connection between the body and the valve member including a cam arrangement having a circumferentially extending cam groove and a cam follower, the arrangement being such that the cam follower will only move in one direction along the groove and the position of the valve member will change in a predetermined sequence.

2. The tool of claim 1, wherein the body further comprises a valve seat for cooperation with the valve member to prevent flow through the bore when the valve member is in the first position, and to permit flow through the bore when the body is in the second position.

3. The tool of claim 1, wherein the cam groove extends completely around the circumference of the valve member to allow the apparatus to be cycled indefinitely.

4. The tool of claim 1, wherein the valve member is moveable between three or more circumferentially spaced positions.

5. The tool of claim 1, wherein the valve member is moveable between three or more axially spaced positions.

6. The tool of claim 1, wherein spring means is provided for biassing the valve member in one direction relative to the body and a bearing is provided between the spring means and one of the body and valve member for reducing the rotational friction therebetween.

7. The tool of claim 1, further comprising a connection for linking the valve member to a further downhole tool to permit the movement of the valve member to be utilised to actuate said further tool.

8. A downhole tool comprising:

a tubular body for location in a tubular member and defining a body wall, a longitudinal through bore and a flow port through the body wall;

a tubular valve member mounted in the bore and being moveable relative to the body between a first position in which fluid may flow through the port at a first flowrate and a second position in which the valve member closes the port, the valve member being moveable between the first and second positions by application of differential fluid pressure; and control means for controlling movement of the valve member between the first and second positions in the form of a connection between the body and the valve member including a cam arrangement having a circumferentially extending cam groove and a cam follower, the arrangement being such that the cam follower will only move in one direction along the groove and the position of the valve member will change in a predetermined sequence, the body further comprising a valve seat for cooperation with the valve member to prevent flow through the bore when the valve member is in the first position, and to permit flow through the bore when the body is in the second position.

9. A downhole tool comprising:

a tubular body for location in a tubular member and a defining a body wall, a longitudinal through bore and flow port through the body wall;

a tubular valve member mounted in the bore and being moveable relative to the body between a first position in which fluid may flow through the port at a first flowrate and a second position in which the valve member closes the port, the valve member being moveable between the first and second positions by application of a differential fluid pressure; and control means for controlling movement of the valve member between the first and second positions in the form of a connection between the body and the valve member including a cam arrangement having a circumferentially extending cam groove and a cam follower, the arrangement being such that the cam follower will only move in one direction along the groove and the position of the valve member will change in a predetermined sequence, the body further comprising a valve seat for cooperation with the valve member to prevent flow through the bore when the valve member is in the first position, and to permit flow through the bore when the body is in the second position, and wherein the valve seat is retrievable from the body.

10. A downhole tool comprising:

a tubular body for location in a tubular member and defining a body wall and a longitudinal through bore;

a tubular member mounted in the bore and being axially and rotatably moveable relative to the body between a first position and a second position, the valve member being moveable between the first and second positions by application of differential fluid pressure across the valve member;

a valve seat mounted on the body for cooperation with the valve member to prevent flow through the bore when the valve member is in the first position, and to permit flow through the bore when the body is in the second position; and control means for controlling movement of the valve member between the first and second positions.

11. The tool of claim 10, wherein the control means is in the form of a connection between the body and the valve member and includes a cam arrangement including a cam groove and a cam follower, the arrangement being such that the cam follower will only move in one direction along the groove in response to decreases and increases in fluid pressure and the position of the valve member will change in a predetermined sequence.

12. The tool of claim 11, wherein the cam groove extends completely around the circumference of the valve member.

13. The tool of claim 10, wherein the valve member is moveable between three or more circumferentially spaced positions.

14. The tool of claim 10, wherein the valve member is moveable between three or more axially spaced positions.

15. The tool of claim 10, wherein spring means is provided for biassing the valve member in one direction relative to the body and a bearing is provided between the spring means and one of the body or valve member for reducing the rotational friction therebetween.

16. The tool of claim 10, further comprising a connection for linking the valve member to a further downhole tool to permit the movement of the valve member to be utilised to actuate said further tool.

17. A downhole tool comprising:

a tubular body for location in a tubular member and defining a body wall and a longitudinal through bore;

a tubular valve member mounted in the bore and being axially and rotatably moveable relative to the body between a first position and a second position, the valve member being moveable between the first and second positions by application of differential fluid pressure across the valve member;

a valve seat mounted on the body for cooperation with the valve member to prevent flow through the bore when the valve member is in the first position, and to permit flow through the bore when the body is in the second position; and control means for controlling movement of the valve member between the first and second positions.

18. A downhole tool comprising:

a tubular body for location in a tubular member and defining a body wall and a longitudinal through bore;

a tubular valve member mounted in the bore and being axially and rotatably moveable relative to the body between a first and a second position, the valve member being moveable between the first and second positions by application of differential fluid pressure across the valve member;

a valve seat mounted on the body for cooperation with the valve member to prevent flow through the bore when the valve member is in the first position, and to permit flow thorough the bore when the body is in the second position; and control means for controlling movement of the valve member between the first and second positions, wherein the valve seat is retrievable from the body.

* * * * *